United States Patent [19]

Morane

[11] Patent Number: 4,870,805

[45] Date of Patent: Oct. 3, 1989

[54] METHOD OF PACKAGING A FLUID UNDER PRESSURE, AND PACKAGING CONTAINER FOR USE WITH THE METHOD

[75] Inventor: Bruno Morane, Neuilly, France

[73] Assignee: L'Oreal, Paris, France

[21] Appl. No.: 203,696

[22] Filed: Jun. 7, 1988

[30] Foreign Application Priority Data

Jun. 19, 1987 [FR] France ..... 87 08605

[51] Int. Cl.[4] ..... B65D 83/14

[52] U.S. Cl. ..... 53/470; 222/386.5; 222/394

[58] Field of Search ..... 222/386.5, 399, 394; 206/219; 53/474, 470, 79, 239

[56] References Cited

U.S. PATENT DOCUMENTS

| | | | |
|---|---|---|---|
| 3,949,911 | 4/1976 | Morane | 222/394 X |
| 4,360,131 | 11/1982 | Reyner | 222/386.5 |
| 4,376,500 | 3/1983 | Banks et al. | 222/386.5 |
| 4,478,044 | 10/1984 | Magid | 222/386.5 X |
| 4,679,706 | 7/1987 | Magid et al. | 222/386.5 X |

*Primary Examiner*—James F. Coan

*Attorney, Agent, or Firm*—Cushman, Darby & Cushman

[57] ABSTRACT

A flexible gas-tight, hermetically sealed pouch (11), in which a likewise closed cartridge (8) filled with a propellant in the liquid phase is disposed, is introduced into the outer envelope (1) of a container (1*a*), and the container (1*a*), which includes a valve (7) for distributing fluid (13) contained in it or introduced via the valve (7) is plugged. The cartridge (8) used has a wall capable of degrading at least partially from simple contact with the propellant, until the cartridge opens, within a period of time at least equal to that necessary to assure the packaging and closure of the container (1*a* ). The propellant then spreads within the pouch (11), changing at least in part to the gaseous phase, at a pressure suitable to assure the dispensing of the fluid (13). By the judicious choice of the characteristics (type, thickness) of the degradable zone of the cartridge (8), heating or other more complicated or expensive means proposed heretofore for putting the container under pressure are avoided.

15 Claims, 1 Drawing Sheet

METHOD OF PACKAGING A FLUID UNDER PRESSURE, AND PACKAGING CONTAINER FOR USE WITH THE METHOD

BACKGROUND OF THE INVENTION

The present invention relates to a method and a container for packaging a fluid under pressure that is intended to be dispensed in a paste, liquid or aerosol form, the fluid to be dispensed being put under pressure by means of a propellant. The invention relates to the situation in which for reasons of safety, quality or conformity of the fluid to be dispensed, the fluid to be dispensed must be prevented from coming into contact with the propellant both before and during use.

Various packaging means meeting these objectives have already been proposed, among which the one having recourse to neither internal mechanical devices nor expensive packaging means while being absolutely safe in its function will be recalled, that is, the means described in French Patent No. 2 229 241.

In the technique that is the subject of this patent, a fluid intended to be dispensed in the aforementioned form is packaged under pressure by introducing a flexible, gas-tight, hermetically sealed pouch, on the inside of which is a cartridge, also closed and filled with a propellant in the liquid phase into the outer envelope of the packaging container, opened at one of its ends, preferably prior to the introduction of the fluid to be dispensed; the free end of the container is plugged, the closed container thus constituted including a valve enabling at least the dispensing of the packed fluid; and after having filled the container with fluid to be dispensed, the opening of the cartridge and the passage of at least some of the propellant to the gaseous phase are effected, causing the propellant to spread into the entire internal free volume of the pouch, at a pressure suitable to assure the dispensing of the fluid around the pouch, from the valve with which the container is provided.

In a preferred embodiment, the opening of the cartridge is brought about by heating the container, filled with the fluid to be dispensed that surrounds the pouch, to a temperature sufficient to enable the opening of the cartridge under the influence of the increase in internal pressure of the propellant.

It is also stated that the opening of the cartridge can be accomplished by dissolving it, at the end of a period of time that can be determined in advance, in a solvent initially located in the flexible pouch.

SUMMARY OF THE INVENTION

The assignee of the present application has sought to further simplify this method, by avoiding either the step of heating, as in the first embodiment above, or the use of a solvent, which represents an additional ingredient and an additional method step, in the second embodiment above.

To this end, according to the invention, a cartridge is used the characteristics (type, thickness) of which are selected so that it can be at least partly degraded under the influence of the propellant alone, until it opens, with a delay sufficiently long to perform the packaging, but sufficiently short to obtain the liberation of the propellant within a reasonable period of time.

The subject of the present invention is therefore a method of packaging under pressure of a fluid intended to be dispensed in paste, liquid or aerosol form, by which:

- a flexible gas-tight, hermetically sealed pouch, with a likewise closed cartridge filled with a propellant in the liquid phase disposed inside it, is introduced into the outer envelope of the packaging container, which is open at one of its ends;
- the free end of the container is plugged, the thus-closed container including a valve with which the fluid can at least be dispensed;
- the fluid is introduced into the container, if this has not already been done, the cartridge then being susceptible to being opened so that the propellant will spread over the entire free internal volume of the pouch, passing at least in part to the gaseous phase, at a pressure that assures that the fluid surrounding the pouch will be dispensed from the valve,
- characterized in that a cartridge is used of which at least one zone of the wall delimiting the propellant can be degraded by simple contact with the propellant until the cartridge opens, within a period of time at least equal to that necessary for assuring the complete packaging and closure of the container.

In accordance with a first embodiment, a cartridge is selected in which the degradable wall zone is made of a material for which the propellant used is at least in part a solvent. In this case, a silicone rubber, in particular, is used as the constituent material of the degradable wall zone of the cartridge, the propellant being at least one of the chlorofluorinated hydrocarbons known by the trade name "Freons" sold by DuPont de Nemours, or butanes, or dimethyl ether.

In a second embodiment, a cartridge is selected in which the degradable wall zone is made of a material capable of undergoing stress cracking under the infleunce of at least a portion of the propellant used. In particular, polystyrene is used as the constituent material of the degradable wall zone of the cartridge, and the propellant is at least one of the chlorofluorinated hydrocarbons known by the trade name "Freons", for example dichlorodifluoromethane (F12), it being understood that the propellant must not cause the immediate stress cracking of the cartridge, as trichlorofluoromethane (F11), in particular, would do.

In this second embodiment, optionally, an agent capable of accelerating the phenomenon of stress cracking is introduced into the cartridge. In particular, this agent may be selected from among the lower alcohols with $C_2$–$C_6$, for example ethyl alcohol and isopropyl alcohol.

In accordance with another important characteristic of the method according to the invention, the flexible pouch is slipped inside the container, and it is pressed against the inside surface of the lateral wall of the container, in such a manner that the fluid to be dispensed occupies the entire free central portion of the container.

The subject of the present invention is also the novel industrial product comprising a container for the packaging under pressure of a fluid intended to be dispensed in paste, liquid or aerosol form, including, inside its outer envelope, which is provided with a valve permitting at least the dispensing of the packaged fluid, a flexible, gas-tight, hermetically sealed self-contained pouch, inside which is disposed a cartridge, which is initially closed and filled with a propellant in the liquid phase; the opening of the cartridge is effected by the passage to the gaseous phase of at least some of the propellant occupying the entire free inside volume of the pouch at a pressure suitable for assuring the dispensing of the fluid surrounding the pouch from the valve, characterized in that at least one zone of the wall of the cartridge used, delimiting the propellant, is selected with characteristics enabling it to be degraded by simple contact with the propellant until the opening of the cartridge is brought about; once under pressure, the container encloses the cartridge in a state resulting from this degradation.

In accordance with a first embodiment, the degradable wall zone of the cartridge is made of a material soluble in at least a portion of the propellant; once under pressure, the container encloses the material in the at least partially dissolved state.

In accordance with a second embodiment, the degradable wall zone of the cartridge is made of a material capable of undergoing stress cracking under the influence of at least a portion of the propellant; once under pressure, the container encloses the fragments of the cartridge produced when it cracks and bursts. In certain cases, the cartridge may initially contain at least one agent intended for accelerating the phenomenon of stress cracking, for example a lower alcohol with $C_2$14 $C_6$.

Furthermore, it is preferable for the free inside volume of the flexible self-contained pouch, in the inflated state, to be greater than the inside volume of the packaging container.

The propellant is in particular at least one of the chlorofluorinated hydrocarbons known by the trade name "Freons", or butanes, or dimethyl ether. Moreover, it is desirable for the gaseous propellant filling the flexible pouch to be under a pressure on the order of 1 to 10 bars.

In accordance with an important characteristic, the container is provided with a dipping tube. One end of the dipping tube is connected to the dispensing valve, and the other, open end discharges substantially in the plane of the bottom of the container, and the dipping tube also includes at least one additional opening, slightly set back from its zone of attachment to the valve, allowing the fluid to be dispensed to circulate.

The cartridge may also be made from a length of flexible tubing, hermetically sealed, in particular by heat sealing, at its two ends, or may comprise a rigid tube provided with a base and closed with a stopper.

The invention will be better understood from the ensuing detailed description of two purely exemplary and non-limiting embodiments shown in the accompanying drawings.

DESCRIPTION OF THE PREFERRED EMBODIMENTS

Figure 1:
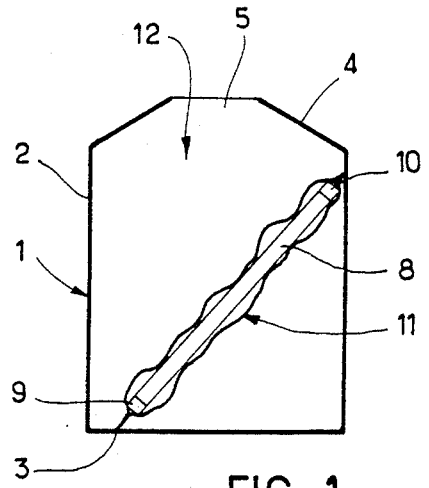
FIG. 1 is a schematic axial section showing a packaging container after the introduction of the flexible pouch inside which is a cartridge of propellant in accordance with a first embodiment of the invention, prior to the introduction of the fluid to be dispensed.

Turning now to FIGS. 1–5, reference numeral 1 designates the entirety of the outer envelope of a packaging container 1*a* according to the invention. This envelope 1 is generally in the form of a cylinder, the lateral wall 2 of which is affixed to a base 3, for example by crimping. The upper portion 4 of the outer envelope has undergone a molding operation which has made it conical in shape. The upper end of this upper portion 4 has an opening 5, which at least after the introduction of the propellant will be plugged by means of a valve-holder cap 6 crimped to the free edge of this portion 4 and in its central region including a valve 7 enabling at least the dispensing of the packaged fluid, and, as applicable, also enabling the introduction of this fluid to the inside of the packaging container. A conventional dipping tube 7*a*, in particular, is associated with this valve 7.

To make the packaging container 1*a*, a cartridge 8, filled with the propellant in the liquid phase, is first made.

This cartridge 8 comprises a length of silicone rubber tubing closed at its two ends 9 and 10, for example by heat sealing or by binding, as described in the aforementioned French Patent No. 2 229 241 and containing the propellant in the liquid phase, which is for example at least one of the group including the chlorofluorinated hydrocarbons known by the trade name "Freons", butanes and dimethyl ether.

For making such cartridges 8, one can also proceed as described in this French patent, that is, by closing one of the end of a tube of silicone rubber several meters in length, filling this tube with the propellant in the liquid phase, closing the tube at its other end, and dividing it into compartments, which is done by disposing from place to place, in a modular manner, a pair of clamping collars that tightly pinch the tube in two very close zones, and by cutting the tube apart along the median line separating two adjacent collars.

In an exemplary embodiment, the cartridge 8 is formed by a tube of flexible silicone rubber which corresponds in length of to the dimensions of the pouch 11 to be described below; its inside diameter is 4 mm and the outside diameter is 7 mm. If the silicone cannot be heat-sealed, then a first clamp is placed on one end of the tube, the tube is filled at a sufficiently low temperature with an adequate quantity of liquefied propellant, and then a second clamp is put in place to close the other end of the tube, and then the tube is sealed inside the pouch.

After packaging in the can 4, the propellant begins to dissolve the wall; in the case of the propellant F12, the final pressure develops in the pouch at the end of 6 hours.

The cartridge 8 is slipped inside the flexible pouch 11, made of a gas-tight foil material that is inert with respect to the fluid 13, for example polyethylene, or a two or three-layered film, one of the layers being an aluminum foil and the other layer or layers being of polyethylene.

The pouch 11, welded closed, defines a hermetically sealed container inside which the cartridge 8 is disposed. During the operation of closing the flexible pouch 11, an at least partial vacuum may optionally be provided inside the pouch 11, or the pouch 11 can simultaneously be compressed or deformed in such a way that the air trapped inside the pouch 11, after its closure, will be at a pressure preferably less than atmospheric pressure.

The pouch 11, hermetically sealed, is then introduced inside the outer envelope 1 of the container 1*a* through the opening 5 (FIG. 1). The pouch is completely self-contained, that is, independent of the container 1*a* and of any of its accessories, the valve-holder cap 6 or valve 7.

In an exemplary embodiment, the pouch 11 is made from a three-layer film comprising the following:

| | | |
|---|---|---|
| PET | 12 μm | (polyethylene/terephthalate) |
| Aluminum | 8.5 μm | |
| PP | 75 μm | (polypropylene) |
| Total | 95.5 μm | |
| or: | | |
| PET | 12 μm | (polyethylene/terepthalate) |
| Aluminum | 12 μm | |
| PE | 75 μm | (polyethylene) |
| Total | 99 μm | |

The pouch is formed by folding a film as described above, 160 by 190 mm in size, over onto itself so as to juxtapose the two faces of PP or PE. Next, by heat sealing, two outer edges approximately 10 mm in size are sealed, the cartridge containing the liquefied propellant is introduced, and the third edge is closed by heat sealing.

This pouch, 80 by 190 mm is size, is coiled onto itself and introduced into an aerosol can 40 mm in diameter. After the can is filled with the product, the valve cap is crimped on.

The pouch 11 can be introduced in any manner to the inside of the container 1*a*. which may have any other shape, either after the introduction of the fluid to be dispensed or at the same time as the fluid to be dispensed, or preferably prior to this introduction, in particular for the sake of convenience and handling.

However, care will be taken to introduce, into the inside of a container of a predetermined inside volume, a flexible pouch 11 which once it has been completely inflated is capable of occupying a volume greater than the inside volume of the container, such that the inflated pouch has a tendency to occupy the entire interior of the container and consequently to facilitate the evacuation of the fluid to be dispensed.

Thus for a container having an inside volume of 200 $cm^3$, for example, a flexible pouch will be introduced which once it has been inflated will occupy a volume on the order of 250 to 300 $cm^3$. Inside this pouch, a tube 15 cm in length, 5 mm in inside diameter and 6 mm in outside diameter is provided, the inside volume of the tube thus being on the order of 3 $cm^3$.

As indicated above, the pouch 11 is slipped inside the container 1, preferably prior to the introduction of the fluid to be dispensed. The pouch 11 is introduced through the opening 5, as schematically indicated by the arrow 12 in FIG. 1, without any particular precautions, or preferably is introduced and pressed against the inside surface of the lateral wall 1 of the container 1*a*, as shown in solid lines in FIG. 5.

Figure 2:
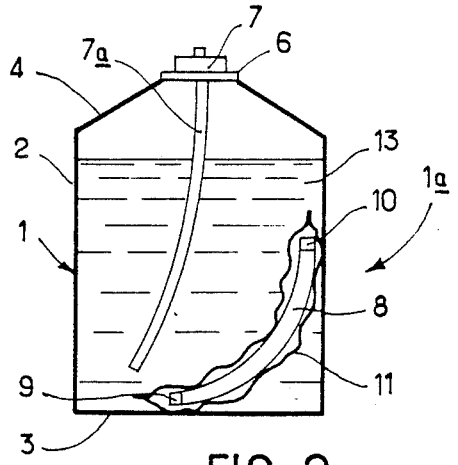
FIG. 2, in schematic axial section, shows the container of FIG. 1 after the introduction of the fluid to be dispensed and after the closure of its free end.
Figure 3:
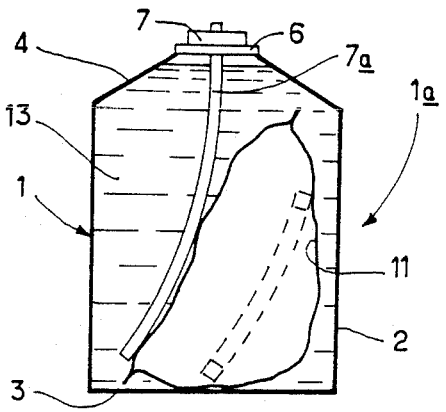
FIG. 3, in schematic axial section, shows the container of FIG. 2 after the bursting of the cartridge and passage to the gaseous state of at least part of the propellant, which spreads over the entire, inside volume of the flexible pouch.

The product 13 to be dispensed is then introduced inside the container 1*a*, either directly through the opening 5, the container then being later closed with the valve-holding cap 6 and the valve 7, or by way of this valve 7 after the valve has been affixed to the container via its valve-holding cap 6 (FIG. 2).

The container 1*a* thus formed is in all cases plugged at its upper free end; it contains the fluid 13 to be dispensed surrounding the pouch 11 inside which the cartridge 8 is located.

At the end of a period of approximately 10 minutes after the manufacture of the cartridge 8 filled with the propellant in the liquid phase, a period during which the packaging operations resulting in the container as shown in FIG. 2 have been accomplished, the silicone rubber comprising the wall of the cartridge 8 begins to dissolve in the propellant. The silicone behaves somewhat like a sponge; at the end of a certain period of time, the sponge is completely impregnated and allows the gas to escape to the outside, until there is an equilibrium in the internal and external pressures. The time when this change begins varies depending on the thickness of the wall and on the nature of the gases used. The liberated propellant at least partly changes to the gaseous phase, which causes the inflation of the pouch 11 (see FIG. 3), thus putting the liquid contents of the container 1*a* under pressure, without producing contact between this liquid contents and the propellant.

Figure 5:
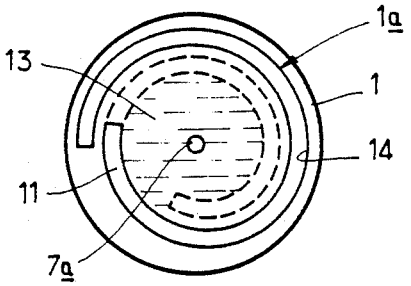
FIG. 5 is a schematic view in transverse section of the container of FIG. 1, after the introduction of the flexible pouch, which is, however, disposed differently on the inside of the container.

The propellant, which is at least partly in the gaseous phase, has the tendency to occupy all the free inside volume of the pouch !1, and it can more easily do so in the particular case shown in FIG. 5, where it can occupy the entire free central portion of the container 1*a*, which is more favorable to good dispensation, without, however being able to prevent a certain fraction of the fluid 13 in every case from coming to be located between the inside face of the lateral wall 1 and the outer edge 14 of the pouch 11.

It is clear that the quantity of liquid propellant introduced into a cartridge must be calculated so that the gaseous quantity corresponding to it will be under a pressure on the order of 1 to 10 bars, which is a pressure sufficient to assure the dispensing of the fluid 13 surrounding the pouch 11 from the valve 7 with which the container 1*a* is provided. As the fluid 13 is dispensed, under the influence of the internal pressure assured by the propellant, the flexible pouch 11 has the tendency to deform and to occupy the entire inside volume of the container 1*a*, until the complete disappearance of the packaged fluid. In the particular case of the embodiment of FIG. 5, the flexible pouch 11 deforms and becomes elongated, forming a spiral that shifts toward the center of the container 1*a* and occupies the entire volume left free by the packaged product dispensed from at the valve 7; the spiral deformation of the flexible pouch 11 is shown in dashed lines in FIG. 5.

Figure 4:
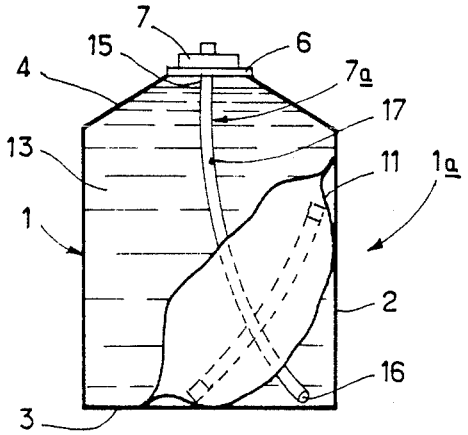
FIG. 4 is a view similar to FIG. 3, but showing a packaging container the dipping tube of which is made in a variant manner, permitting the dispensing of all the packaged fluid, without any of the volume of this fluid still being contained between the inflated flexible pouch and the inside wall of the container once the dispensing has been completed.

To prevent the trapping of a certain quantity of packaged fluid between the wall of the container 1*a* and the inflated flexible pouch 11, which occupies an increasingly large volume inside the container 1*a* as more fluid is dispensed, the container 1*a* can advantageously be provided with a dipping tube 7*a*, as shown in FIG. 4, one end 15 of which is connected to the dispensing valve 7 and the other, open end 16 of which discharges substantially in the plane of the base 3 of the container 1*a*; this dipping tube 7*a* furthermore includes at least one complementary opening 17, slightly set back from its zone of attachment to the valve 7, so that in this way the fluid to be dispensed can circulate freely in all cases from the openings 16 and 17 as far as the dispensing valve 7, without any volume of fluid 13 being capable of being retained underneath the inflated pouch 11 and not reaching the dispensing valve 7.

Figure 6:
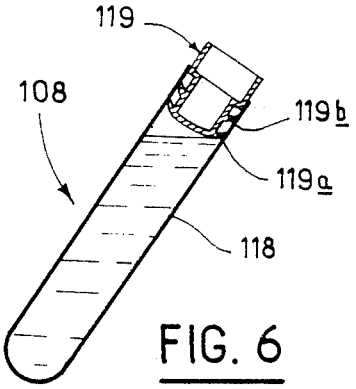
FIG. 6, in axial section, shows a propellant cartridge in accordance with a second embodiment of the invention.

In FIG. 6, a cartridge 108 has been shown in accordance with a second embodiment of the invention. The cartridge 108 shown here comprises a polystyrene tube 118 having a base, of the "test tube" type; the tube 118 is filled with a propellant in the liquid phase (either dichlorodifluoromethane or Freon 12) that is hermetically sealed with a stopper 119, which includes two sealing lips 119*a*, 119*b* for this purpose. At the end of a given period of time, during which the packaging as shown in FIG. 2 can be accomplished, the tube 118 of the cartridge 108 undergoes stress cracking under the influence of the propellant selected; it becomes fragile and permeable, so that the propellant diffuses into the pouch 11 and passes at least partly to the gaseous phase in order to inflate it.

In an exemplary embodiment, the polystyrene tube 118 has a length of approximately 75 mm, an outside diameter of 13 mm and a wall thickness of 1.2 mm. This tube is filled at −30° C. with 7.5 g of Freon 12 and plugged with a polyethylene stopper. One then has from 10 to 15 minutes in order to package this tube in a pouch and fill the can, before the deterioration of the tube ensues. In order to correctly regulate the pressure inside the pouch, 3 g of ethyl alcohol can be added, to arrive at a final pressure of 8 bars.

It will be understood that the embodiments described above are in no way limiting and can be modified in any desirable way, without departing from the scope of the invention.

What is claimed is:

1. A method of packaging under pressure of a fluid to be dispensed in paste, liquid or aerosol form, comprising the steps of:

disposing in a flexible gas-tight, hermetically sealed pouch a closed cartridge with a propellant in the liquid phase, and introducing the pouch with the cartridge into the outer envelope of a packaging container having an opening at one of its ends;

plugging the opening of the container with a plugging means having valve means, the thus-closed container permitting at least the dispensing of said fluid;

introducing the fluid into the container, the cartridge then being openable so that the propellant will spread over the entire free internal volume of the pouch, changing at least in part to the gaseous phase, at a pressure suitable to assure the dispensing of the fluid, surrounding the pouch, from said valve characterized in that the cartridge is of the type wherein at least one zone of the wall delimiting the propellant can be degraded by simple contact with the propellant until the cartridge opens, within a period of time at least equal to that necessary for assuring the complete packaging and closure of said container;

said cartridge having a degradable wall zone made of a material for which the propellant used is at least in part a solvent, said material being a silicon rubber and the propellant being at least one of: the chlorofluorinated hydrocarbons known by the trade name "Freons", butanes and dimethyl ether, and the method includes the step of introducing into the cartridge an agent for accelerating stress cracking.

2. A method as defined claim 1, characterized in that the flexible pouch is placed inside the container and is pressed against the surface of the lateral wall of said container, in such a manner that the fluid to be dispensed occupies the entire free central portion of the container.

3. A method of packaging under pressure of a fluid to be dispensed in paste, liquid or aerosol form, comprising the steps of:

disposing in a flexible gas-tight, hermetically sealed pouch a closed cartridge filled with a propellant in the liquid phase, and introducing the pouch with the cartridge into the outer envelope of a packaging container having an opening at one of its ends;

plugging the opening of the container with a plugging means having valve means, the thus-closed container permitting at least the dispensing of said fluid;

introducing the fluid into the container, the cartridge then being openable so that the propellant will spread over the entire free internal volume of the pouch, changing at least in part to the gaseous phase, at a pressure suitable to assure the dispensing of the fluid, surrounding the pouch, from said valve characterized in that the cartridge is of the type wherein at least one zone of the wall delimiting the propellant can be degraded by simple contact with the propellant until the cartridge opens, within a period of time at least equal to that necessary for assuring the complete packaging and closure of said container;

the degradable wall zone of the cartridge being made of a material capable of undergoing cracking under the influence of at least a portion of the propellant used and including the step of introducing into the cartridge an agent for accelerating stress cracking;

4. A method as defined by claim 3, characterized in that the agent capable of accelerating the phenomenon of stress cracking is selected from the lower alcohols with C Y2 Y-C Y6 Y, including ethyl alcohol and isopropyl alcohol.

5. A method as defined by claim 3, characterized in that polystyrene is used as the constituent material of the degradable wall zone of the cartridge, the propellant being at least one of the chlorofluorinated hydrocarbons known by the trade name "Freons", including dichlorodifluoromethane.

6. A container having an outer envelope for the packaging under pressure of a fluid intended to be dispensed in paste, liquid or aerosol form, said envelope having a dispensing valve means for permitting the dispensing of the packaged fluid, a flexible, gas-tight, hermetically sealed, self-contained pouch inside which is disposed a cartridge, which is initially closed and filled with a propellant in the liquid phase, the opening of said cartridge being effected by the passage at least in part to the gaseous phase of the propellant occupying the inside volume of the pouch at a pressure suitable for dispensing of the fluid surrounding the pouch from the valve, characterized in that at least one zone of the wall of the cartridge, delimiting the propellant, is selected so as to be degraded by contact with the propellant resulting in the opening of said cartridge, said container enclosing said cartridge and becoming pressurized upon escape of the propellant from said cartridge;

the degradable wall of the cartridge being made of a material soluble in at least a portion of the propellant, said container, once under pressure, enclosing said material in the at least partially dissolved state, said cartridge containing at least one agent intended for accelerating the phenomenon of stress cracking.

7. A container as defined by claim 6 characterized in that the propellant is at least one of the group comprising the chlorofluorinated hydrocarbons known by the trade name "Freons", butanes and dimethyl ether.

8. A container as defined by claim 6, characterized in that the gaseous propellant filling the flexible pouch is at a pressure on the order of 1 to 10 bars.

9. A container as defined by claim 6, characterized in that it is provided with a dipping tube, one end of which is connected to the dispensing valve, and the other, open end of which discharges substantially in the plane of the bottom of the container, said dipping tube further including at least one additional opening, slightly set back from its zone of attachment to the valve, enabling the circulation of the fluid to be dispensed.

10. A container as defined by claim 6, characterized in that the cartridge is made from a length of flexible tubing, hermetically sealed at its two ends, in particular by heat sealing.

11. A container as defined by claim 6, characterized in that the degradable wall zone of the cartridge is made of a material capable of undergoing stress cracking under the influence of at least a portion of the propellant, said container, once under pressure, enclosing the fragments of the cartridge resulting from cracking of material of said zone.

12. A container as defined by claim 6, characterized in that the cartridge comprises a rigid tube provided with a base and closed with a stopper.

13. A container as defined by claim 6, characterized in that the free inside volume of the flexible self-contained pouch, in the inflated state, is greater than the inside volume of the packaging container.

* * * * *